United States Patent [19]

Divisek et al.

[11] Patent Number: 4,773,982

[45] Date of Patent: Sep. 27, 1988

[54] ELECTROLYZER WITH SANDWICH ARRANGEMENT OF DIAPHRAGM AND ELECTRODES AND METHOD OF PRODUCING THE SANDWICH ARRANGEMENT

[75] Inventors: Jiri Divisek; Peter Malinowski, both of Jülich, Fed. Rep. of Germany

[73] Assignee: Kernforschungsanlage Jülich Gesellschaft mit beschränkter Haftung, Jülich, Fed. Rep. of Germany

[21] Appl. No.: 873,180

[22] Filed: Jun. 11, 1986

[30] Foreign Application Priority Data

Jun. 12, 1985 [DE] Fed. Rep. of Germany ... 8517106[U]

[51] Int. Cl.[4] ..... C25B 9/00; C25B 13/02; C25B 13/08

[52] U.S. Cl. ..... 204/266; 204/282; 204/279

[58] Field of Search ..... 204/282-283, 204/252-258, 279, 286, 98

[56] References Cited

U.S. PATENT DOCUMENTS

| | | | |
|---|---|---|---|
| 3,674,767 | 7/1972 | Fogelman | 204/286 |
| 4,174,259 | 11/1979 | Rucker et al. | 204/283 X |
| 4,356,231 | 10/1982 | Divisek et al. | 428/304.4 |
| 4,377,462 | 3/1983 | Baker et al. | 204/282 X |
| 4,394,244 | 7/1983 | Divisek et al. | 204/295 |
| 4,559,124 | 12/1985 | Divisek et al. | 204/295 |
| 4,568,439 | 2/1986 | Sobieniak | 204/279 X |

FOREIGN PATENT DOCUMENTS

| | | | |
|---|---|---|---|
| 0065275 | 6/1978 | Japan | 204/98 |

*Primary Examiner*—Donald R. Valentine
*Attorney, Agent, or Firm*—Nils H. Ljungman

[57] ABSTRACT

An electrolyzer for alkaline electrolysis of water has a diaphragm-electrode sandwich arrangement wherein a predetermined narrow spacing to provide a minimum distance is maintained between the diaphragm surface and the superjacent electrode. The spacing is provided by a single layer of a filament of predetermined thickness disposed in an array. The filament is strung in a plurality of lengths disposed in a common plane so that the thickness of the spacing is the same as the thickness of the single layer which is equal to the filament thickness. The array is secured by a retaining wire which engages a groove provided in a cell frame of the electrolyzer. The filament is made of plastic material which can withstand electrolysis conditions. An apparatus and method for stringing the filament to provide the array are also described.

18 Claims, 5 Drawing Sheets

ELECTROLYZER WITH SANDWICH ARRANGEMENT OF DIAPHRAGM AND ELECTRODES AND METHOD OF PRODUCING THE SANDWICH ARRANGEMENT

CROSS-REFERENCE TO RELATED CO-PENDING APPLICATIONS AND ISSUED U.S. PATENTS

Co-pending application Ser. No. 649,043, filed on Sept. 10, 1984, entitled "Hydrogen Permeation Membrane", which corresponds to Federal Republic of Germany Laid Open Patent Application No. P 33 32 348.8, published on or about Mar. 8, 1985; co-pending application Ser. No. 750,858, filed on July 1, 1985, entitled "Improved Diaphragm for Alkaline Electrolysis and Process For Manufacture of Diaphragm", which corresponds to Federal Republic of Germany Laid Open Patent Application No. P 34 24 203.1, published on or about Dec. 30, 1985; U.S. Pat. No. 4,559,124, issued Dec. 17, 1985, entitled "An Improved Nickel Oxide Based Diaphragm"; U.S. Pat. No. 4,584,065, issued Apr. 22, 1986, entitled "Activated Electrodes"; and U.S. Pat. No. 4,589,891, issued May 20, 1986, entitled "Hydrogen Permeation Membrane, Process For Its Manufacture And Use", are all assigned to the same assignee as the instant application and are incorporated herein by reference as if the entire contents thereof were set forth herein in their entirety.

BACKGROUND OF THE INVENTION

1. Field of the Invention

The invention relates generally to electrolytic diaphragms and more particularly to an electrolyzer with a sandwich arrangement comprising a diaphragm and electrodes, as well as an appropriate method and apparatus for producing the sandwich arrangement. The arrangement provides a dimensionally stable, electrically insulating diaphragm and permeable electrodes.

2. Description of the Prior Art

Electrolyzers are known to consist of one or usually several electrolytic cells assembled and combined into a cell block. An individual cell is formed by boundary plates or bipolar separating plates, which define an electrolysis chamber. This electrolysis chamber is in turn separated by a diaphragm into anode and cathode chambers. The anode and cathode can be in contact with the diaphragm in a sandwich construction, if the diaphragm is not itself an electrical conductor. Generally, however, the electrodes are not in contact with the diaphragm, but rather are at a distance of approximately 1 to 3 mm from the diaphragm in practice.

Of particular current industrial interest in the context of this invention are electrolyzers for alkaline electrolysis, specifically the electrolysis of water, to which specific reference is made in the present description.

For alkaline electrolysis of water, the applicant has developed a sandwich configuration with a porous, electrically non-conducting oxide diaphragm disposed in contact on both sides with active electrodes, which is used here as a specific example to explain the invention.

Prior art sandwich arrangements known heretofore have been constructed with electrodes which are either of sheet metal configured in the form of louvers, or a type of rib mesh or slotted sheet metal. Consequently, in prior arrangements, in the region between the diaphragm and the electrochemically active main portion of the electrode, there has always been a certain spacing on the order of several millimeters, which spacing represents an additional electrical resistance and thereby leads to energy losses in comparison with the so called desirable "zero distance" concept.

However, the "sandwich structure" sometimes also has a functional disadvantage which is absent in the ordinary prior art structures which are energetically more wasteful. The diaphragm can remain functional only if the diaphragm pores are not blocked, and only if no deposits are caused to be formed on the electrodes. The electrode deposits deleteriously propagate into the diaphragm which is located adjacent to the electrode. Naturally, this demands that the entire cell system including the periphery must be corrosion-resistant so that practically no deterioration by corrosion takes place. Corrosion products would, as a result of the electrode reactions, either precipitate or be deposited cathodically as metals or anodically as oxide hydrates, and would migrate from the electrodes into the diaphragm and would be deposited to coat the diaphragm or could even lead to short circuits. In practice, however, it is very difficult, or at least very expensive and commercially uneconomical, to maintain corrosion-free conditions.

In other words, the reduction of electrode distance, which on the one hand is energy-favorable and therefore economical, is linked with operational problems of the diaphragm becoming disfunctional, whereas the prior art solution, which incorporates a certain substantial distance between diaphragm and electrodes, is cheaper and functionally satisfactory, but less advantageous and less economical from an energy standpoint.

OBJECTS OF THE INVENTION

It is an object of the present invention, therefore, to provide a solution to these problems, that is, to find a constructive solution in which the energy losses caused by the diaphragm-electrode distance or spacing are small.

It is further object of the present invention to provide construction materials which can nevertheless be used for the cell and periphery which are appropriately corrosion resistant at an acceptable price, even if they do not necessarily totally prevent corrosion in an absolute sense.

It is a yet further object of the present invention to provide an arrangement to obtain a predetermined narrow spacing between the insulating diaphragm and an adjacent electrode in such a manner that gases generated are not obstructed from flowing across and migrating as intended, and in such a manner that gas pockets are not formed next to the diaphragm.

It is another object of the present invention to provide a means to maintain the narrow spacing in a stable manner.

It is yet another object of the present invention to provide a method or process of producing sandwich arrangements having such narrow spacings.

SUMMARY OF THE INVENTION

These objectives are achieved, according to embodiments of the present invention, by thin plastic or polymer filaments of a thickness in the range of 50 to 500 $\mu$m which extend in an array or layout in the gas flow direction within the cells, that is, each filament extends substantially vertically along the diaphragm surface with a space of 5 to 50 mm between the filaments, wherein the filament thickness of 50 to 500 μm defines the spacing between the diaphragm and electrode. Preferred filament space intervals are between 10 and 20 mm, and filament thicknesses of approximately 200 μm are particularly advantageous.

The invention in its broad form comprises a diaphragm-electrode sandwich arrangement in an electrolyzer. The sandwich arrangement comprises an electrically insulating diaphragm having at least one side surface and at least one electrode disposed with a predetermined spacing from the side surface of the diaphragm. The spacing between the diaphragm and the electrode is defined by a predetermined array formed by a filament of known diameter. The filament is disposed in a single layer of thickness which is equal to the known diameter of the filament. The invention also includes means to realize said array.

Also described and claimed herein is a method of establishing and maintaining the predetermined spacing between the diaphragm and the electrode, comprising the steps of:

(a) choosing a filament having a diameter equal to the predetermined spacing;

(b) forming a single layer array from the chosen filament along the side surface of the diaphragm or the electrode in such a manner that the single layer array has the same thickness as the diameter of the chosen filament; and (c) fastening the single layer array to retain the predetermined spacing, in use, of the electrolyzer cell.

The plastic filaments must, of course, be of such material and so made as to be able to withstand electrolysis conditions, and expediently consist particularly of polytetrafluoroethylene or other appropriately resistant plastic filament material, such as polysulfone.

The run of the filaments in the direction of gas flow or emission can prevent the formation of permanent, blocking gas pockets between the diaphragm and the electrode. Such gas pockets can have an adverse effect on economical operation of the electrolyzer.

The manner in which the filaments which run in the gas discharge direction (in cell operation) are fastened can basically be selected as desired, since, in use, the contact with the adjacent elements, that is, diaphragm and electrodes, takes care of the retention of the layout once achieved. However, it is particularly advantageous if the filaments are fastened to the cell frame, specifically in a groove on the frame provided precisely for that purpose, preferably immediately adjacent to the electrolyte chamber.

The filament ends can be clamped in such a groove by means of a thin wire or a wire coil.

BRIEF DESCRIPTION OF THE DRAWINGS

A particularly appropriate mounting apparatus for the filaments, as will be explained in the following description of the embodiments, is schematically illustrated in the accompanying figures, in which.

DESCRIPTION OF THE PREFERRED EMBODIMENTS

Figure 1:
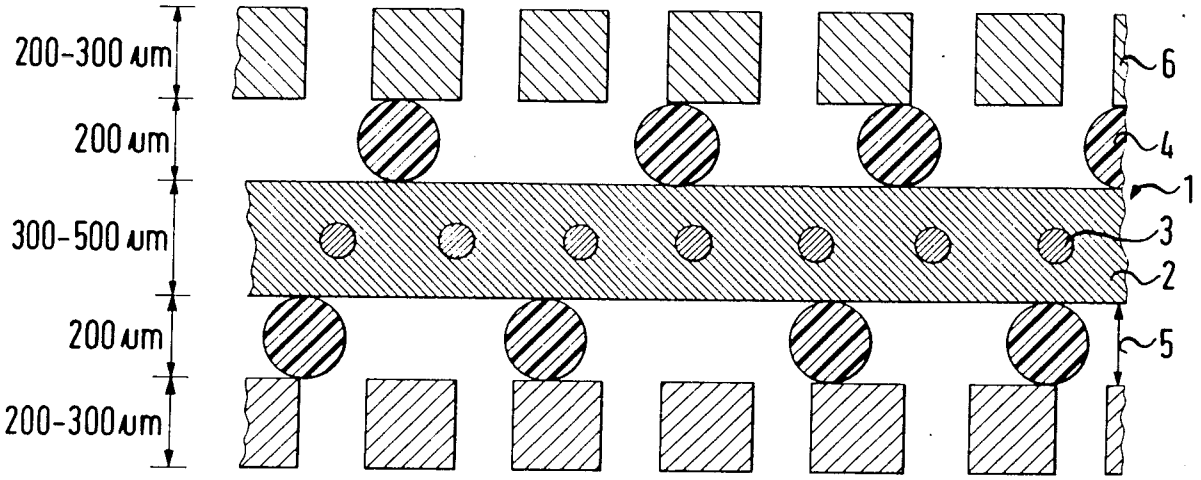
FIG. 1 shows a diagrammatic illustration in cross-section, of the construction of a diaphragm-electrode sandwich according to an embodiment of the invention, viewing in a direction perpendicular to the gas flow direction.

As illustrated in FIG. 1, an electrically insulating, dimensionally stable diaphragm 1 consists specifically of porous nickel oxide 2 on a structural framework 3. The diaphragm 1 is separated from a permeable electrode 6 by a single layer of fibers 4, which preferably comprise a plastic material resistant to electrolysis conditions, to form a gap or spacing interval 5. The electrode 6 is preferably formed by an activated perforated plate electrode. Alternatively, a metal grid electrode or louvered electrode or even a porous activated electrode can also be used.

The fibers 4 are so disposed on the diaphragm 1 that gas formed on the front side of the electrodes can escape unhindered to the gas collection line of the electrolyzer, without the formation of gas pockets.

The dimensions indicated in FIG. 1 for the structural framework, spacing and permeable electrode are to be understood only as examples, and can be varied as necessary and as guided by design considerations.

Figure 3:
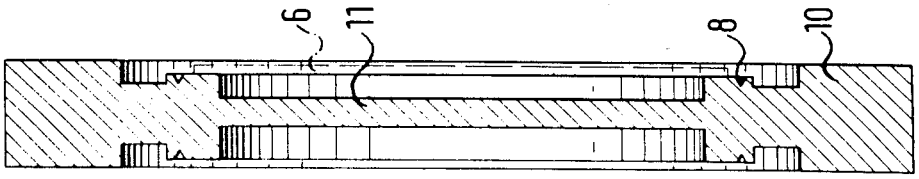
FIG. 3 shows a diagrammatic illustration in cross-section, of the cell frame provided with grooves before the filament mounting.
Figure 2:
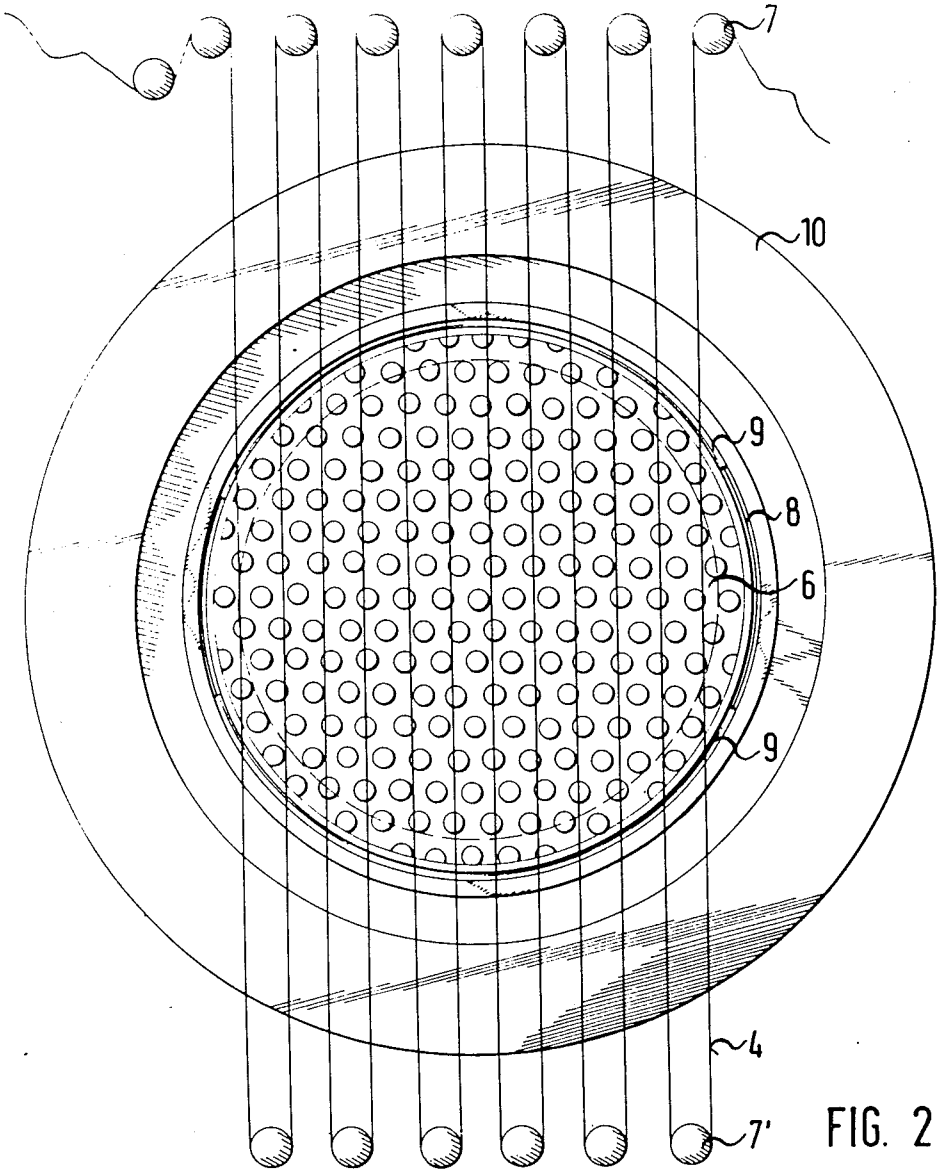
FIG. 2 shows a diagrammatic illustration of the filaments stretched in the gas flow direction (during the mounting)

The plastic filaments 4 are strung or spread, as shown in FIG. 2, by means of offset guide rollers 7, 7', over which the filaments 4 run back and forth in serpentine fashion and are laid in a groove 8 (as shown in FIG. 3) with a wire or wire coil 9 pressed, as for example, by hammering, over the filaments. The projecting filament ends beyond the groove 8 are appropriately cut away, before the installation of the diaphragm 1 and the final commissioning of the cell by closing the cell frame 10 which surrounds a bipolar plate 11.

Figure 4:
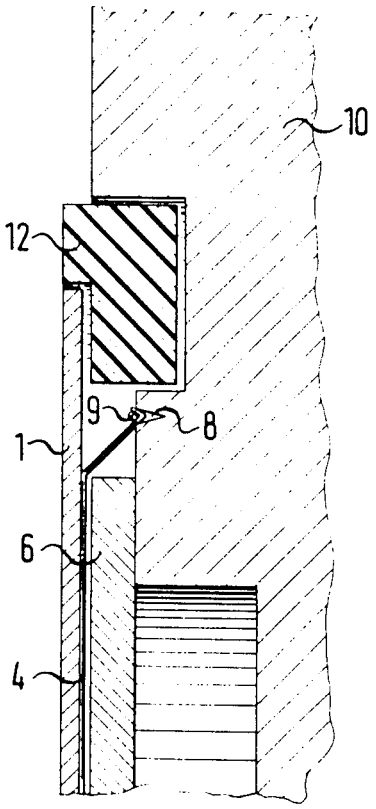
FIG. 4 shows an enlarged pictorial detail of a filament fastened in the frame groove between the diaphragm and electrode before the cell is closed.

FIG. 4 shows the arrangement of a cell frame 10, the electrode 6, filaments 4 and the diaphragm 1 with the cell and diaphragm seal 12 in enlarged detail.

Figure 6:
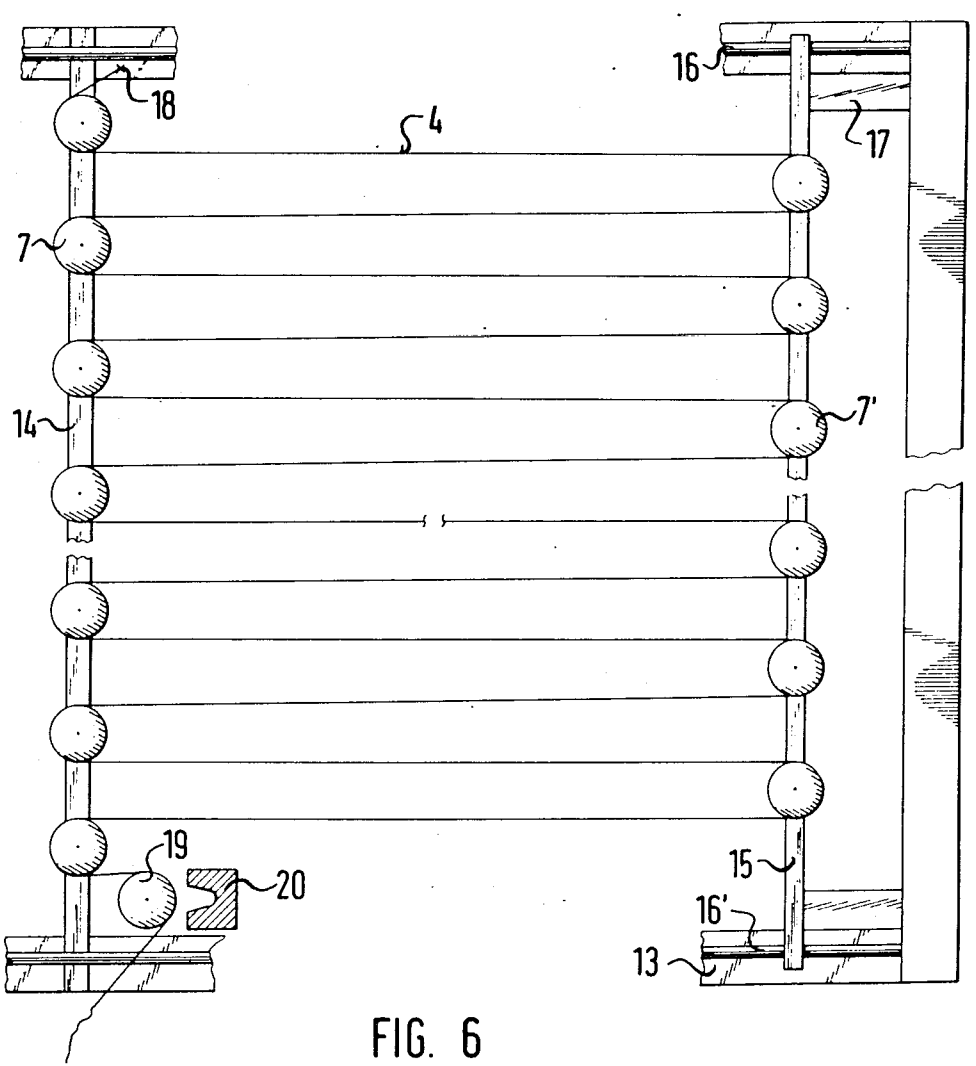
Figure 5:
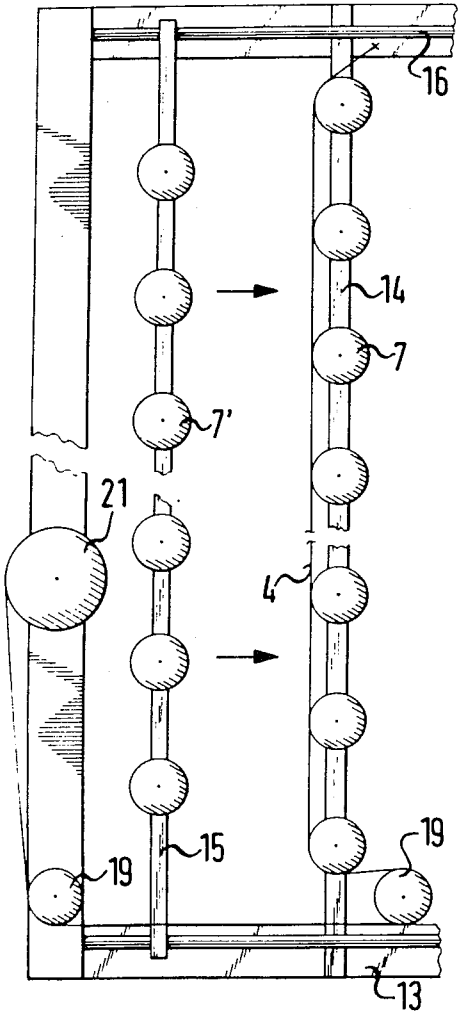
FIGS. 5 and 7 pictorially show various phases of the filament mounting, using an apparatus which employs pulleys on a special frame.
Figure 7:
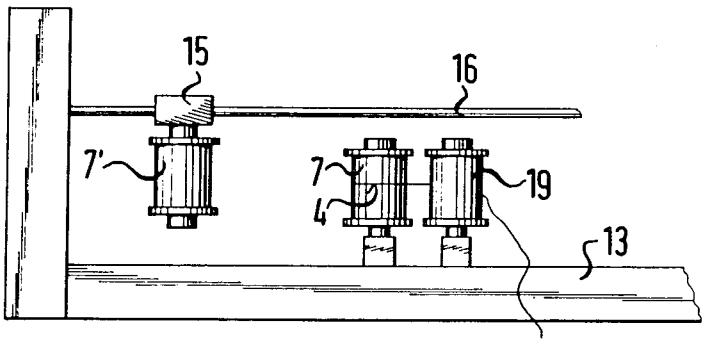

An apparatus which is particularly appropriate for the installation of the filaments 4 proposed by the invention is illustrated in FIGS. 5 through 7.

The apparatus illustrated comprises a frame 13 with a fixed roller rail 14 and a movable roller rail 15 with the rollers 7 and 7' respectively, which offset from one another, over which the filament 4 is strung. The movable rail 15 is held parallel to the fixed rail 14 by guides 16 and 16'.

The movable rail 15 can ride over the fixed rail 14 (see especially FIG. 7). The rollers 7' of the movable rail 15 are suspended so that they are offset from the rolls 7 of the fixed rail 14, whereby the rollers 7 and 7' are located practically in the same plane.

As shown in FIG. 5, the filament 4, which is initially guided only over the rollers 7 of the fixed rail 14 is carried along upon the movement of the rail 15, by the intervening rollers 7', and is pulled in the manner of a screen or harp over the surface of the electrode underneath, (or eventually of the diaphragm underneath). During this process, the filament should still be at a slight distance from the element beneath (the surface of the electrode or diaphragm, as appropriate). After the movable rail 15 is at a backstop (at 17), or after it is fastened at the desired distance from the fixed rail 14, for example, with clamping or attachment screws (whereby the apparatus can be adjusted to different cell sizes), the filament 4 is brought into contact beneath with the electrode (or the diaphragm, as the case may be), by lowering one or both sides of the frame.

The configuration then corresponds to the one illustrated in FIG. 2, but without the clamping wire or the clamping coil. The clamping wire or coil is then installed and pressed in by hammering or a similar process, whereupon the portions of the filament projecting outward beyond the groove are cut away.

The mounting bolts of a cell block can be used, for example, as a guide for the frame 13 relative to the electrode, over which the string portions of the filament are stretched.

The filament, spread in the manner of a harp or screen by separating the roller rails 14 and 15 from each other, especially runs from a dispenser roll 21, which can be mounted on the frame 13.

The free end of the filament is attached at 18, for example, by means of a clamp, and the filament is made to run over a tension roller or idler 19 to the dispenser roll 21.

To align the mounting frame 13 to the cell frame 10, appropriate adapters or aligning elements can be used, as shown at 20, which can e.g. engages the mounting bolts of the cell block and thereby enable a simple orientation of the mounting frame 13.

For the stretching or spreading of the filament 4 over electrodes which may have a relatively large surface area, the filament 4, which in principle is continuous in the mounting, can of course be divided expediently into sections formed by a series of filaments, which extend from a number of dispenser rolls, so that from each individual dispenser roller, only one filament length is dispensed which runs over 10 rollers, for example. This number of dispenser rollers is then accompanied by a corresponding number of tension rollers, and the filament ends of the filament pieces are also fastened by a suitable number of fastener elements 18. Alternatively, the spreading of the filament across larger surfaces can be done step-wise, by a chronologically sequential or partial spreading each time of a filament portion, which runs only over 10 rollers, for example.

The filament 4 guaranteeing a minimum spacing interval between electrode and diaphragm is specifically provided on the anode side, since a certain minimum distance between the anode and the diaphragm is of particular importance. Generally, however, the filament is disposed, in practice, on both sides of the diaphragm, that is, on the cathode side as well as on the anode side.

It is seen from the foregoing that the invention provides a novel diaphragm sandwich arrangement for electrolysis and a method of mounting the arrangement, wherein by virtue of the spacing formed by the strung single layer of filament disposed as a grate screen at least on one side of the diaphragm, electrolysis can be performed in a highly energy efficient manner without sacrificing performance. The need for a minimum spacing between the diaphragm and an adjacent electrode during electrolysis is satisfied by the invention with the minimum distance arrangement which the filaments achieve. Any unnecessary or undesirable additional electrode separation is obviated, whereby the arrangement offers higher energy efficiency over all previous commercially known prior art arrangements. By using the arrangements of the present invention, an electrode can be assembled close enough to the electrolysis diaphragm to ensure low electrical energy consumption, at the same time ensure functional continuity preventing harmful electrode deposits from reaching the diaphragm. The preferred material recommended herein for the filaments is any plastic material which can withstand electrolysis conditions, for example, polytetrafluoroethylene or polysulfone. The corrosion resistance and the low cost of the filament strung preferably on the electrode to make an efficient electrolysis sandwich make the present invention a highly attractive proposition over prior art. The method of stringing the filament screen as described hereinabove renders the invention highly cost advantageous over any other method which attempts to provide a "minimum distance" between the diaphragm and the electrodes.

The invention as described hereinabove in the context of the preferred embodiments is not to be taken as limited to all of the provided details thereof, since modifications and variations thereof may be made without departing from the spirit and scope of the invention.

What is claimed is:

1. In an electrolyzer cell, a diaphragm-electrode sandwich arrangement comprising:

an electrically insulating form-stable diaphragm having two side surfaces; and at least one electrode disposed with a spacing from said diaphragm on said at least one said side surface;

said spacing being defined by a predetermined array formed by a filament of known thickness, each filament length of said array extending in a gas flow direction in the cell;

said predetermined array being disposed on each of said two side surfaces of said diaphragm;

said filament being disposed of a single layer of thickness which is equal to said known thickness of said filament;

said sandwich arrangement including means to retain said array;

said filament having at least one filament portion, said at least one filament portion being disposed on said retaining means;

said at least one filament portion having been run back and forth in meander-form during fabrication and said at least one filament portion being stretched by said retaining means to form at least a portion of said array of filaments.

2. In an electrolyzer cell, a diaphragm-electrode sandwich arrangement comprising:

an electrically insulating form-stable diaphragm having at least one side surface; and at least one electrode disposed with a spacing from said diaphragm on said at least one side surface;

said spacing being defined by a predetermined array formed by a filament of known thickness, each filament length of said array extending in a gas flow direction in the cell;

said filament being disposed of a single layer of thickness which is equal to said known thickness of said filament;

said sandwich arrangement including means to retain said array, wherein said filament comprises plastic filament in a thickness range of 50 to 500 $\mu$m, and wherein said predetermined array comprises a plurality of runs of said filament, said plurality of runs being strung substantially parallel to each other at an interval of 5 to 50 mm;

said filament having at least one filament portion, said at least one filament portion being disposed on said retaining means;

said at least one filament portion having been run back and forth in meander-form during fabrication and said at least one filament portion being stretched by said retaining means to form at least a portion of said array of filaments.

3. The sandwich arrangement according to claim 2, wherein said plastic filament comprises polytetrafluoroethylene.

4. The sandwich arrangement according to claim 2, wherein said plastic filament comprises polysulfone.

5. The sandwich arrangement according to claim 2, wherein said filament thickness is approximately 200 μm.

6. The sandwich arrangement according to claim 2, wherein said interval between said plurality of substantially parallel runs of said filament is in the range of 10 to 20 mm.

7. In an electrolyzer cell, a diaphragm-electrode sandwich arrangement comprising:

an electrically insulating form-stable diaphragm having at least one side surface; and at least one electrode disposed with a spacing from said diaphragm on said at least one said side surface;

said spacing being defined by a predetermined array formed by a filament of known thickness, each filament length of said array extending in a gas flow direction in the cell;

said filament being disposed of a single layer of thickness which is equal to said known thickness of said filament;

said sandwich arrangement including means to retain said array;

said electrolyzer including a cell frame;

said means to retain said array including said electrolyzer cell frame;

said filament having at least one filament portion, said at least one filament portion being disposed on said retaining means;

said at least one filament portion having been run back and forth in meander-form during fabrication and said at least one filament portion being stretched by said retaining means to form at least a portion of said array of filaments.

8. The sandwich arrangement according to claim 7, wherein said electrolyzer cell frame includes a circumferential groove which can substantially envelope an area of said at least one electrode.

9. The sandwich arrangement according to claim 8, wherein said electrolyzer cell frame further includes retainer wire means, said retainer wire means being disposed in said circumferential groove, in assembly, for retaining said predetermined array.

10. In an electrolyzer cell, a diaphragm-electrode sandwich arrangement comprising:

an electrically insulating form-stable diaphragm having at least one side surface; and at least one electrode disposed with a spacing from said diaphragm on said at least one said side surface;

said spacing being defined by a predetermined array formed by a filament of known thickness, each filament length of said array extending in a gas flow direction in the cell;

said filament being disposed of a single layer of thickness which is equal to said known thickness of said filament;

said sandwich arrangement including means to retain said array;

said sandwich arrangement including an electrolyte chamber;

said means to retain said predetermined array comprising a peripheral groove adjacent to said electrolyte chamber;

said filament having at least one filament portion, said at least one filament portion being disposed on said retaining means;

said at least one filament portion having been run back and forth in meander-form during fabrication and said at least one filament portion being stretched by said retaining means to form at least a portion of said array of filaments.

11. In an electrolyzer of the type which uses a sandwich arrangement, said sandwich arrangement comprising an electrically insulating diaphragm having at least one surface and an electrode spaced on at least one surface of said diaphragm, the improvement residing in the structure of the spacing between at least one of said at least one side surface of said diaphragm and an adjacent electrode, said spacing being defined by a predetermined array formed by in gas flow direction extending parallel filaments of known diameter, said filaments being spaced apart from each other by an interval sufficient to allow gas flow to a gas collector of the cell, and wherein said predetermined array comprises a plurality of lengths of said filament strung in substantially parallel runs at a spacing interval in a range of 5 to 50 mm, said array being held by retaining means, said filament having at least one filament portion, said at least one filament portion being disposed on said retaining means, said at least one filament portion having been run back and forth in meander-form during fabrication and said at least one filament portion being stretched by said retaining means to form at least a portion of said array of filaments.

12. The electrolyzer according to claim 11, wherein said filament comprises polytetrafluoroethylene material.

13. The electrolyzer according to claim 11, wherein said filament comprises polysulfone material.

14. The electrolyzer according to claim 11, including a cell frame, and wherein said means to retain said predetermined array includes:

a circumferential groove in said electrolyzer cell frame; and retainer wire means which, in assembly, locks and retains said substantially parallel runs of said plurality of lengths of said filament within said circumferential groove.

15. In an electrolyzer cell having a sandwich arrangement of an electrically insulating diaphragm with at least one side surface and at least one electrode disposed substantially parallel to said at least one side surface of said diaphragm at a predetermined spacing, a method of establishing and maintaining said spacing, said method comprising the steps of:

(a) choosing a filament having a diameter equal to said predetermined spacing;

(b) forming a single layer array from said chosen filament over said at least one side surface of said diaphragm in such a manner that said single layer array has the same thickness as said chosen filament diameter by threading at least a portion of said filament in a meander-form back and forth across said diaphragm; and (c) fastening said single layer array to retain said predetermined spacing in use of said electrolyzer cell, and wherein said step of forming a single layer array comprises disposing said chosen filament in a single layer in a plurality of substantially parallel lengths which are strung at a spacing interval in a range of 5 to 50 mm.

16. The method according to claim 15, wherein said step of fastening said single layer array comprises fastening said plurality of substantially parallel lengths of said chosen filament in a circumferential groove formed in said electrolyzer cell by using a retainer wire which is force-assembled into said circumferential groove.

17. In an electrolyzer cell, a diaphragm-electrode sandwich arrangement comprising:

an electrically insulating form-stable diaphragm having at least one side surface;

at least one electrode disposed with a spacing from said diaphragm on said at least one said side surface;

said spacing being defined by a predetermined array formed by a filament of known thickness, each filament length of said array extending in a gas flow direction in the cell;

said filament being disposed of a single layer of thickness which is equal to said known thickness of said filament;

said sandwich arrangement including means to retain said array;

a cell frame; and an apparatus for mounting said array of filaments between said diaphragm and said electrode, said apparatus for mounting comprising a mounting frame including aligning means to align said mounting frame to said cell frame, said mounting frame comprising:

a first fixed roller rail on one side of said cell frame;

a second movable roller rail, having rolls which are disposed to be offset with respect to the rolls of said first fixed roller rail, and being movable across said cell frame to the other side of said cell frame;

guide means arranged parallelly to a gas flow direction of the mounted cell, said guide means being disposed for controlling the movement of said second movable roller rail across the cell frame area away from said first fixed roller rail;

at least one means for fixing a loose end of at least one filament portion; and at least one tension roll for the other end of said at least one filament portion;

said at least one filament portion having been run in meander-form during fabrication alternatively over said rolls of said fixed and said movable roller rails.

18. In an electrolyzer cell, a diaphragm-electrode sandwich arrangement comprising:

an electrically insulating form-stable diaphragm having at least one side surface; and at least one electrode disposed with a spacing from said diaphragm on said at least one said side surface;

said spacing being defined by a predetermined array formed by a filament structure of known filament thickness, said known filament thickness being in a thickness range of about 50 to about 500 $\mu$m, said filament structure comprising filament lengths being disposed substantially parallel to one another, said filament lengths being disposed in a single layer between said at least one electrode and said diaphragm, each filament length of said array for extending in a gas flow direction in the cell during use;

said filament structure being disposed of a single layer of thickness which is substantially equal to said known filament thickness of a single filament; and said sandwich arrangement including means to retain said array;

said filament having at least one filament portion, said at least one filament portion being disposed on said retaining means;

said at least one filament portion having been run back and forth in meander-form during fabrication and said at least one filament portion being stretched by said retaining means to form at least a portion of said array of filaments.

* * * * *